US005104149A

United States Patent [19]

Hoppe

[11] Patent Number: 5,104,149

[45] Date of Patent: Apr. 14, 1992

[54] IDENTITY CARD AND A METHOD FOR PRODUCING AN IDENTITY CARD

[75] Inventor: Joachim Hoppe, Munich, Fed. Rep. of Germany

[73] Assignee: GAO Gesellschaft fur Automation und Organisation mbH, Fed. Rep. of Germany

[21] Appl. No.: 646,410

[22] Filed: Jan. 28, 1991

Related U.S. Application Data

[63] Continuation of Ser. No. 424,724, Oct. 20, 1989, abandoned.

[51] Int. Cl.[5] ..... B42D 15/00

[52] U.S. Cl. ..... 283/94; 283/74; 346/135.1

[58] Field of Search ..... 283/94, 67, 70, 72, 283/74, 94, 107, 904; 346/135.1

[56] References Cited

U.S. PATENT DOCUMENTS

| | | | |
|---|---|---|---|
| 2,545,804 | 3/1951 | Butler | 283/107 |
| 4,325,196 | 4/1982 | Gauch et al. | 156/277 |
| 4,451,068 | 5/1984 | Hall et al. | 283/75 |
| 4,544,181 | 10/1985 | Maurer et al. | 283/94 X |
| 4,560,426 | 12/1985 | Moraw | 156/277 |
| 4,627,642 | 12/1986 | Peronneau et al. | 283/94 X |
| 4,629,215 | 12/1986 | Maurer et al. | 283/94 |

*Primary Examiner*—Timothy V. Eley
*Assistant Examiner*—William Fridie, Jr.
*Attorney, Agent, or Firm*—Bacon & Thomas

[57] ABSTRACT

An identity card, e.g. a check card or credit card, usually has a field in which the card user writes has signature when the card is handed over. A weakness that manipulators of the cards could exploit up to now was that the signature field could be detached and replaced by an imitated signature field. To make such manipulation easily recognizable and thus impede forgery, the invention proposes making the security print (guilloche print), that covers the surroundings of the signature field anyway, extend without interruption across the signature field as well. Whereas it is already extremely difficult to imitate a signature field provided with such a security print, it is virtually impossible to dispose the security print in such a way that is passes continuously from the signature field into the surroundings of the signature field (FIG. 1).

10 Claims, 2 Drawing Sheets

IDENTITY CARD AND A METHOD FOR PRODUCING AN IDENTITY CARD

This application is a continuation of application Ser. No. 07/424,724, filed Oct. 20, 1989 now abandoned.

BACKGROUND OF THE INVENTION

The present invention relates to an identity card and to a method of producing such an identity card.

Identity cards of the type in question here are, for example, check cards, credit cards, membership cards and the like, the card structure corresponding generally to ISO Standard 7813 (DIN 9781).

Such identity cards are designed for example as multilayer plastic cards. On the front of the card there is general information, such as the name of a credit institute, and user-related information, such as the printed name of the user, his account number, the card number and the like. Furthermore, the user's signature is present on a special signature field. When the card is handed out, the user is usually requested to put his signature in the special signature field.

In order to avoid forgery and falsification, the identity cards are produced and designed in such a way as to rule out imitation and/or fraudulent manipulation of the card.

The safety measures include the card structure itself. For example, a multilayer card structure made of plastic, in which the data are located in the interior of the card between layers welded together using heat and pressure, prevents direct access to the data and thus their falsification.

A further safety feature is a so-called security print, usually a guilloche print but possibly also a logo, a microprint of sequences of letters and numbers and the like. Due to their complicated design, such security prints serve in particular to prevent both total forgeries—i.e. complete reproductions—and falsification.

A frequent object of such unauthorized manipulation is the signature of the authorized user located on the card. In order to rule out falsification, i.e. manipulation, of these signatures, particularly the signature field must thus be equipped with special safety features to prevent the signature of the authorized card user from being removed and replaced by a manipulator's signature. Since the signature is generally written on the surface of the finished card, the signature field must firstly take up the ink permanently, and secondly be designed in such a way that any attempts at erasure will lead to a change in the signature field that can be checked by anyone and is preferably conspicuous.

Various methods and measures have been proposed for protecting signature stripes from forgery, i.e. reproduction and/or manipulation.

German patent no. 27 56 692 describes an identity card in which a signature stripe made of paper or plastic and provided with steel intaglio printing is laminated onto the card body. Since the signature stripe is very difficult to imitate due to the special and complicated steel intaglio print, there is a relatively low risk of the proper stripe being replaced by a forged stripe.

German laid open print no. 16 46 225 shows an identity card having a glued-on signature stripe equipped with a security pattern that is destroyed by any attempt to remove the old signature, and thereby exposes a warning print (void). However, one could fundamentally replace the destroyed signature stripe by a reproduction.

It has also been proposed to make a signature stripe printed onto the card body unforgeable by using special inks, e.g. fluorescent inks (German patent no. 28 01 015, European laid open print no. 176 403). An otherwise valid identity card of this type could also be provided with a forged signature stripe. German patent no. 34 22 908 describes an identity card in which a hologram additionally provided in the signature field is to protect the signature stripe from forgery that is provided on the card body by the hot embossing technique. However, the production of such cards using the hot embossing technique is elaborate, and the hologram can be replaced by a deceptively similar metallically reflecting image (simulacrum counterfeit).

Apart from the above-mentioned attempts to make the signature stripe unforgeable, there are also proposals according to which the signature is invisible when regarded in daylight or artificial light from usual light sources and can only be made visible using special light sources, e.g. using a UV lamp. This limits the possibilities of checking so as to be unacceptable in many cases.

British laid open print no. 2 040 807 describes an identity card wherein a microcapsule layer located within the card body is discolored by application of pressure from the outside, e.g. using a hard pen, so that the signature can be provided subsequently in the interior of the card. However, the constant use of this card and the unavoidable mechanical stress thereby destroys more and more microcapsules so that the card shows an undesirable coloration.

U.S. Pat. No. 2,545,804 describes an identity card having a paper inlay and a plastic coating on both sides, one plastic layer having a window through which the free place in the paper inlay can be written on. However no precautions were taken for protecting the signature from forgery.

The above-described known identity cards have the common feature that the signature must be made personally. Along with identity cards of this kind, there are also those in which the signature is applied by electrophotographic means or by a laser. German patent no. 29 33 436 shows an identity card in which not only the user-related information (card number, account number and the like) but also the signature are applied electrophotographically to a security paper inlay which is then laminated with plastic films on each side. German patent no. 29 07 004 describes an identity card in which all user-related information, including the signature, is burned into the paper inlay through a transparent cover film.

However, the invention is based on the problem of providing an identity card which is easy to produce and allows for the signature to be written on the signature field, after completion of the card, visibly and in a form that subsequently cannot be changed, in particular replaced. Another objective is to state a method for producing such an identity card.

This problem is solved by the invention stated in claim 1 and claim 6. Advantageous developments are stated in the subclaims.

In the inventive identity card, the security print normally provided on the card body for security purposes extends across the signature field applied, for example, by the screen printing technique. The predetermined pattern of the security print is continuous on the boundary between the signature field and the surroundings of the signature field. It is virtually impossible to detach the material of the signature field and replace the detached field by another field, since the security print—if it is imitable at all—can certainly not be adapted continuously to the print in the surrounding area of the signature field. The color coordination of the signature print on the signature field and surroundings also rules out forgery. The signature field, which hitherto had a clearly independent appearance, can be readily included in the overall appearance of the inventive identity card.

In particular, the production of the signature field can be readily included in the production process for the card body. Both the security print and the signature field can be produced e.g. by the screen printing technique. In order to protect the card after the security print has been applied, one preferably provides a transparent protective layer on the security print, the protective layer leaving a window through which the signature can be subsequently provided on the signature field.

A further measure for increasing the protection from forgery is that the security print is aperiodic from card to card. Security prints, e.g. guilloche prints, usually have periodic patterns and according to the invention the card length, for example, is not an integral multiple of the pattern periodicity.

In the inventive method, the signature field is first applied and only then the security print, in such a way that the print at least partly overlaps the signature field. The special advantages of the method are apparent when the signature field is produced e.g. by screen printing and then the security print applied continuously across the signature field from the surroundings existing in the form of a plastic surface. Both method steps are customary printing methods which can be carried out with relatively little effort. In order to obtain a very fine security print in particular in the signature field and in the area of the boundary between the signature field and the surroundings, one can perform an intermediate lamination between the screen printing operation and the security printing operation. This intermediate lamination smooths the surface of the card body provided with the signature field, so that the security print can be applied to a homogeneous, flush surface.

To protect the card one preferably provides a transparent cover film, leaving out the area of the signature field. Instead of a cover film, which has a thickness of about 80 μm, one can also apply a substantially thinner layer of varnish consisting of artificial resin, e.g. two-component resin, UV-hardenable resin or the like, again leaving out the signature field. Such a layer of varnish has about the same height as the screen printing of the signature field (about 10 μm). If the card body is varnished with artificial resin the window can be formed by printing technology. After varnishing the card can be completed by another lamination to make the card surface completely smooth.

DESCRIPTION OF THE DRAWINGS

In the following, exemplary embodiments of the invention shall be explained in more detail with reference to the drawing, in which.

DESCRIPTION OF THE PREFERRED EMBODIMENTS

Figure 1:
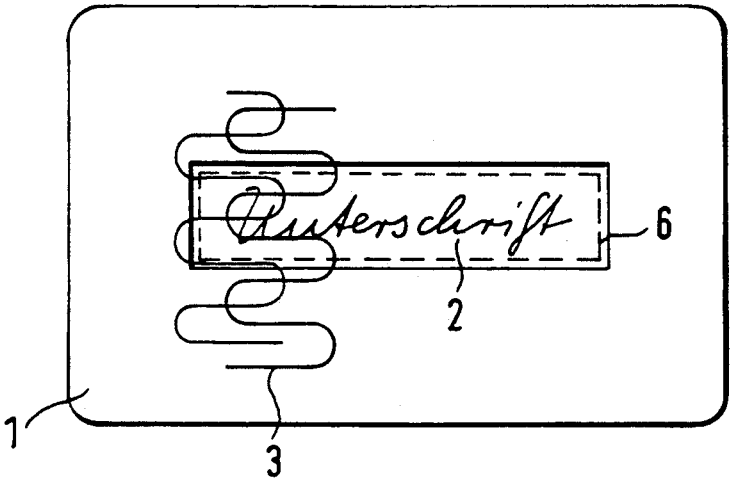
FIG. 1 shows a front view of an inventive identity card.

As shown by FIG. 1, a signature field 2 is provided approximately in the center of a card body 1 designed here as an all-plastic card. The signature field is, for example, a printed layer applied by screen printing using absorbable inks, i.e. a layer which permanently absorbs e.g. ballpoint pen ink or other inks used in customary writing utensils. Other printing methods for applying layer materials having the property of subsequent writability are, for example, intaglio printing or tampon printing. The layer forming the signature field can also be transferred to the card surface by the transfer method, in particular by the known hot embossing method. A security print 3 designed as a guilloche print, which is indicated only symbolically in FIG. 1, covers at least part of signature field 2 and adjacent areas of the surface of card body 1. As apparent from FIG. 1, there are no interruptions whatsoever in the pattern of security print 3 on the boundary of signature field 2. This makes the signature field virtually impossible to replace or print over without such manipulation being recognizable by an irregularity in security print 3.

Figure 2:
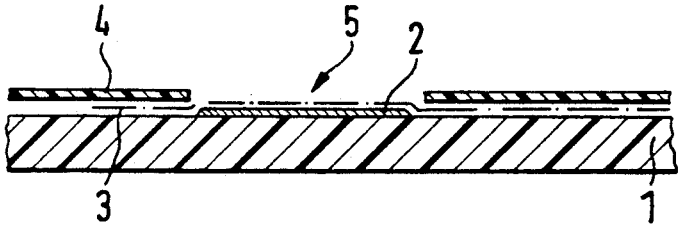
FIG. 2 shows a partially cross-sectional view of identity card.

As indicated by FIG. 2, the card body is formed of a thick plastic layer to which signature field 2 is applied by a suitable printing method. After the signature field is applied, the surface of the card can be laminated to smooth the surface, if desired. Security print 3 is then applied e.g. by the same printing method or by other printing methods suitable for printing fine lines. After a further laminating step a transparent plastic film 4 is applied as a smooth transparent cover. A window 5 is punched out of this cover film 4 so that signature field 2 remains free for the card user to sign subsequently.

The size of window 5 can be freely selected in its limits. As indicated in FIG. 1 by broken limiting line 6, the plastic window can somewhat overlap signature field 2. However, a small peripheral gap can also be provided between the printed surface and the plastic cover, as indicated in FIG. 2. After cover film 4 is applied, the card can again be laminated to smooth the surface. Cover film 4 should be as thin as possible so that the signature field is not covered by the softening cover film material. Film thicknesses of about 80 μm thickness meet this requirement.

Figure 3:
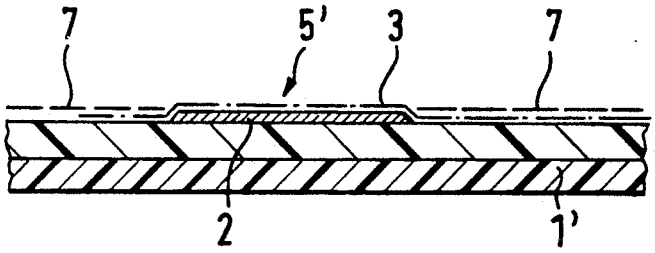
FIG. 3 shows a partially cross-sectional view of another embodiment of an inventive identity card.
Figure 4:
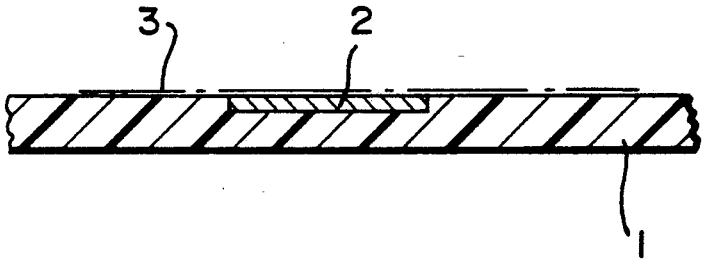
FIG. 4 shows the identity card formed with an intermediate lamination between application of the signature field and the security printing operation.
Figure 5:
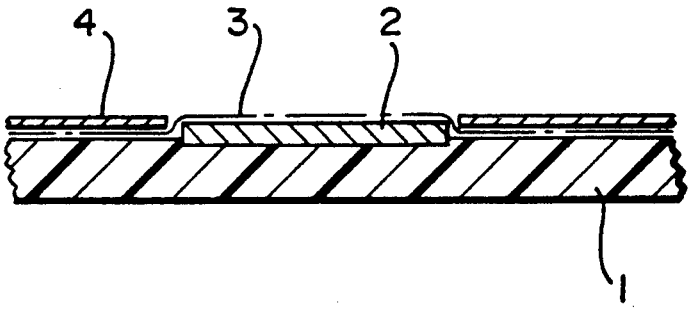
FIG. 5 shows the card with an additional lamination following the varnishing step.

Instead of a cover film one can provide a layer of varnish consisting of artificial resin. One can easily leave window 5' free above signature field 2 by printing techniques. In FIG. 3, security print 3 is indicated by a dot-dash line; the varnish consisting of transparent artificial resin is represented by a broken line.

Layer of varnish 7 consists for example of UV-hardenable resin. Card body 1' of the identity card of FIG. 3 comprises two plastic layers. Since layer of varnish 7 is approximately as thick as signature field 2 (10 μm), one obtains a virtually uninterrupted, smooth card surface, whose smoothness can even be further improved by a final laminating step.

I claim:

1. In an identity card of plastic material including a layer for bearing information thereon relating to a user of the card and having at least on one side of the layer a security print (3) and a freely accessible signature field (2) in the form of a printed layer of absorbable inks whose surface is thus designed to take up a user's personal signature on a finished identity card, the improvement wherein said security print (3) covers at least part of the signature field (2) and extends continuously from the signature field into the surrounding areas of the card; and wherein within the regions surrounding the signature field (92) but not over the signature field the security print (3) is covered by a transparent protective layer (6) so that the security print is continued from the freely accessible surface of the signature field to beneath the protective layer.

2. The improvement in an identity card according to claim 1, wherein the signature field (2) and the protective layer (4) form a continuous, smooth card surface.

3. The improvement in an identity card according to claim 1, wherein the protective layer is a transparent varnish layer consisting of resin.

4. The improvement in an identity card according to claim 2, wherein the protective layer is a transparent varnish layer consisting of resin.

5. A method of producing an identity card having a plastic card layer bearing at least on one side information relating to a user of the card and having at least on one side a security print and a signature field in the form of a printed layer of absorbable inks whose surface is thus designed to take up a user's personal signature on a finished identity card, comprising the steps of:

applying the security print so as to overlap the signature field at least in part, whereby the security print extends continuously from the signature field into the surroundings existing in the form of a plastic surface, and covering the security print with a transparent protective layer within the surroundings of the signature field but not over the signature field, such that the security print is continued from the freely accessible surface of the signature field to beneath the protective layer.

6. The method of claim 5, including, between the application of the signature field and the security printing operation, laminating the card layers to smooth the card surface.

7. The method according to claim 5 including, following the applying of the protective layer, laminating the card layers to smooth the card surface.

8. The method of claim 5, including applying a transparent film as said transparent protective layer.

9. The method of claim 5, including applying a transparent varnish layer of resin as said transparent protective layer.

10. A method of producing a series of identity cards, each having a plastic card layer bearing at least on one side information relating to a user of the card and having at least on one side a security print and a signature field in the form of a printed layer of absobable inks whose surface is thus designed to take up a user's personal signature on a finished identity card, comprising the steps of forming each card by applying the security print so as to overlap the signature field at least in part, whereby the security print extends continuously from the signature field into the surroundings existing in the form of a plastic surface, and, covering the security print but not the signature field with a transparent protective layer within the surroundings of the signature field, such that the security print is continued from the freely accessible surface of the signature field to beneath the protective layer; and wherein the security print is applied to each card of the series so that the security print is aperiodic from card to card.

* * * * *